United States Patent [19]

Gibellato

[11] Patent Number: 4,541,507

[45] Date of Patent: Sep. 17, 1985

[54] UNIVERSAL FOLDING LADDER FOR BOATS

[76] Inventor: Silvano Gibellato, Via Caltana, 28, Campodarsego (Province of Padova), Italy

[21] Appl. No.: 659,208

[22] Filed: Oct. 9, 1984

[30] Foreign Application Priority Data

Oct. 14, 1983 [IT] Italy ..... 30818/83[U]

[51] Int. Cl.[4] ..... E06C 5/26; E06C 1/52

[52] U.S. Cl. ..... 182/86; 182/97; 182/33; 182/164

[58] Field of Search ..... 182/86, 95, 206, 163, 182/164, 33, 150

[56] References Cited

U.S. PATENT DOCUMENTS

| | | | |
|---|---|---|---|
| 639,480 | 12/1899 | Winston | 182/95 |
| 1,032,810 | 7/1912 | Bosnyakovits | 182/95 |
| 2,536,966 | 1/1951 | Teller | 182/95 |
| 2,896,831 | 7/1959 | Ellingson | 182/206 |
| 3,021,917 | 2/1962 | Holt | 182/95 |
| 3,078,952 | 2/1963 | Kelling | 182/150 |
| 3,385,399 | 5/1968 | Burt | 182/206 |
| 3,892,290 | 7/1975 | Lang | 182/206 |
| 4,312,536 | 1/1982 | Lloyd | 182/150 |
| 4,457,391 | 7/1984 | Marques | 182/164 |

*Primary Examiner*—Reinaldo P. Machado
*Attorney, Agent, or Firm*—Guido Modiano; Albert Josif

[57] ABSTRACT

A universal folding ladder for inflatable boats and pleasure craft comprising a tubular structure intended for straddling the gunwale of a boat and including at least two L-like elements extending parallel to each other and being interconnected at the ends thereof by at least two adjustable U-like elements, said structure being connected at one side to the boat through a latch means for a catch element, and on the other side to swingingly connected rungs, between the L-like elements there being mounted a flat rest base member including one or more boards.

8 Claims, 5 Drawing Figures

UNIVERSAL FOLDING LADDER FOR BOATS

BACKGROUND OF THE INVENTION

This invention relates to a universal folding ladder for boats which is specially useful with inflatable boats and pleasure craft in general.

Currently available and utilized are boat ladders which comprise essentially a metal support for attachment to a boat's gunwale, and one or two swinging elements connected thereto.

Such prior designs have the disadvantage that they cannot be used on inflatable boats and on different design boats without appropriate alterations.

Further, they cannot be utilized in different applications from their primary intended purpose, and are generally permanently installed.

SUMMARY OF THE INVENTION

It is a primary object of this invention to obviate such prior drawbacks by providing a boat ladder which can be used for both inflatable boats and rigid construction pleasure craft.

Another important object of the invention is to arrange for this boat ladder to be usable on both inflatable boats and other pleasure boats without requiring modifications of its structure to make it fit.

A further object is to provide a boat ladder which can also be used for different applications from basic one.

It is a further object of the invention to provide such a boat ladder which is detachable from a boat equipped with it.

A further object is to provide a boat ladder which can be readily carried around.

A not unimportant object is to arrange for this boat ladder to be relatively inexpensive to manufacture on conventional equipment.

These and other objects are achieved by a universal folding ladder for boats, characterized in that it comprises a tubular structure intended for straddling the gunwale of a boat and including at least two L-like elements extending parallel to each other and being interconnected at the ends thereof by at least two adjustable U-like elements, said structure being connected, on the one side, to the boat through a latch means for catch element, and on the other side, to swingingly connected rungs, between said L-like elements there being mounted a flat rest base member.

BRIEF DESCRIPTION OF THE DRAWINGS

Further features and advantages will be apparent from the following detailed description of a universal folding ladder for boats, as illustrated by way of example in the accompanying drawings I, II,III,IV, and V, where.

DESCRIPTION OF THE PREFERRED EMBODIMENTS

Figure 1:
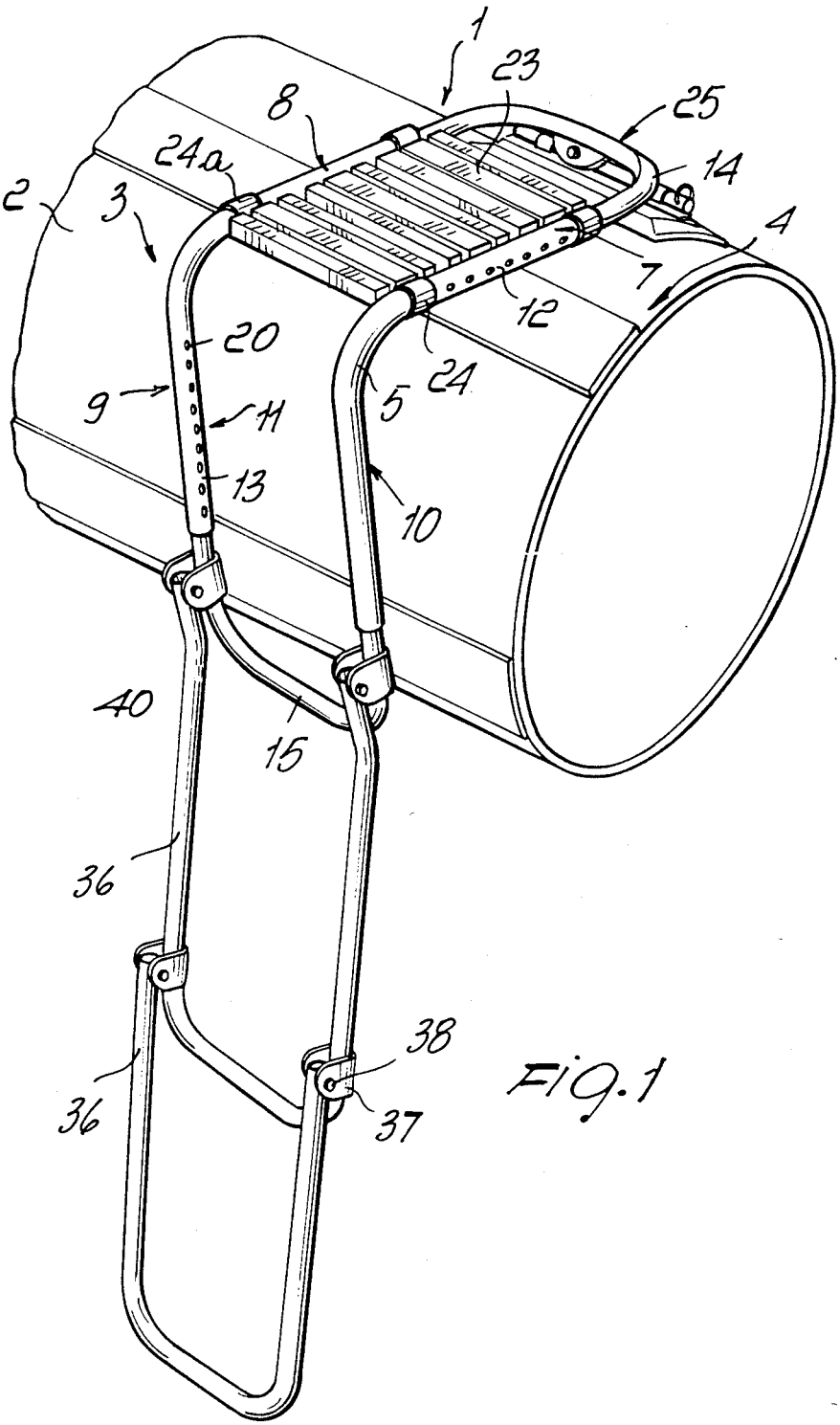
FIG. 1 is a perspective view of this invention, as applied to an inflatable boat and suspended outwardly therefrom.

Making reference to the drawing views, this universal folding ladder 1, designed for use on inflatable boats 2 and pleasure craft in general, comprises a tubular structure 3 straddling the buoyancy tube 4 of an inflatable boat 2.

Said structure 3 comprises, in turn, two L-like elements 5 and 6, extending parallel to each other, which are formed from either stainless steel or aluminum and have in sidepieces 7 and 8, 9 and 10, an array of aligned holes 11 lying, respectively, on the outer side surface 12 and inner one 13.

Such L-like elements 5 and 6 are interconnected at the ends by two U-like elements 14 and 15, having a slightly smaller diameter dimension and being adjustable by means of an adjusting device 16 provided on both their ends 17 and 18.

The device 16 comprises a metal elastic bar 19 of V-like shape which has, welded to one end thereof, a small cylinder 20 which protrudes outwardly from the ends 17 and inwardly from the ends 18, through a larger diameter hole 21 formed therein.

Between the sidepieces 7 and 8 of the L-like elements 5 and 6, there is provided a flat rest base member 22 including one or more boards 23, of either wood or a plastic material, which are made rigid with one another and with the sidepieces 7 and 8 by means of at least four supports 24, of semicylindrical configuration and **24*a*** of cylindrical configuration, with slighly larger diameters than the sidepieces.

The U-like element 14 is provided, on the bottom portion of the rest base 25, with a latch means including a perforated bracket 26 which is welded to the base 25, whereto a pipe section 27 is attached by means of a nut 28 associated with a bolt passed through a short pipe section **28*a*** welded to the former.

Said pipe section 27 has a length which is equal to the distance separating two catch elements 29 of substantially cylindrical configuration and having the same diameter, being formed from either a plastic or metal material and made fast with a flat base **29*a*** of the same material.

The latch is completed by a wire section 30 having a slightly smaller diameter than the pipe sections 27 and elements 28 fitting thereinto, and being attachable thereto by means of a step 31 provided at one of its ends and a fastener located at the other of its ends.

In the particular embodiment shown, the latter would comprise a ring nut 32 threaded onto the wire section 30, a ring 33 passed through the hole 34 being applied to the other end whereto a short line 35 is tied.

Connected to the U-like element 15 are rungs 36 which are swingingly attached by means of metal hinges 37 of C-like configuration fastened to each rung arm, the hinges 37 which belong to one rung having a common hinge axis in the form of a hinge bolt 38 passed through the holes formed at the ends of the rungs and hinge and being locked by means of a nut 39.

Provided at the bottom of the U-like element 15 are at least two contact pads 40 of rubber.

The ladder is used in the following way. After the pipe section 27 has been associated with the catch elements 28 provided on the plate 29, which is made rigid with the gunwale region or top 4 of the boat or the buoyancy tubes of an inflatable boat through the wire piece 30, the ring nut 32 is tightened to prevent the wire from sliding off.

Where no ring nut is provided, the line 35 tied to the ring 33, usually utilized to secure the wire to the structure 3, may be passed around the pipe section 28*a* or the elements 29, and then again tied to the ring 33.

After the tubular structure 3 has been thus fastened to the boat, the position of the same relatively to the gunwale or top 4 can be adjusted by acting on the small cylinders 20 which would be pushed inwards of the sidepieces 7 and 8 to shift the L-like elements 5 and 6 in a longitudinal direction with respect to the U-like element 14.

Owing to the provision of an array of nine holes 11, an optimum distance can be selected for positioning the sidepieces 9 and 10 relatively to the boat 2.

The ladder can be further adjusted along the sidepieces 9 and 10, again by operating the small cylinders 20 which stand proud of the inward side surfaces 13; thus, the U-like element 15 can be pulled out, still longitudinally with respect to the sidepieces 9 and 10, by lowering or raising the underlying swingingly connected rungs 36.

The number of such rungs 36 is variable, and a larger or smaller number of them may be provided by adding or removing C-like hinges 37.

Figure 2:
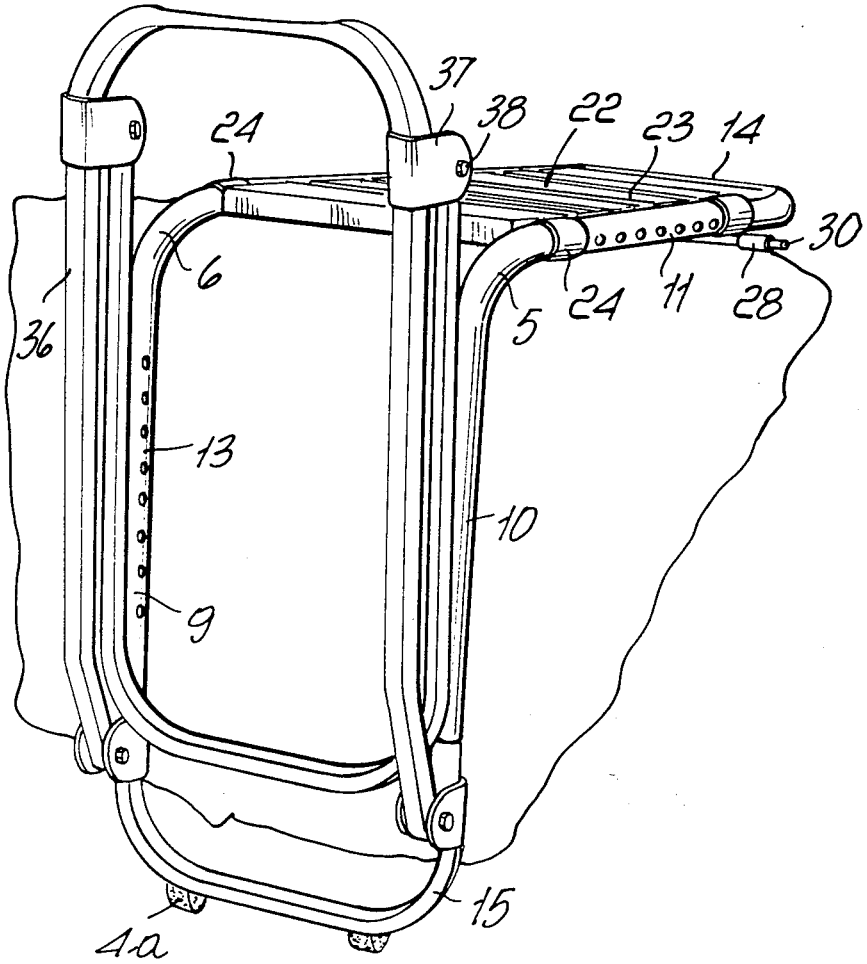
FIG. 2 is a perspective view of the boat ladder as embodied with two swingingly connected rungs, shown folded up and projecting outboard from a boat.
Figure 3:
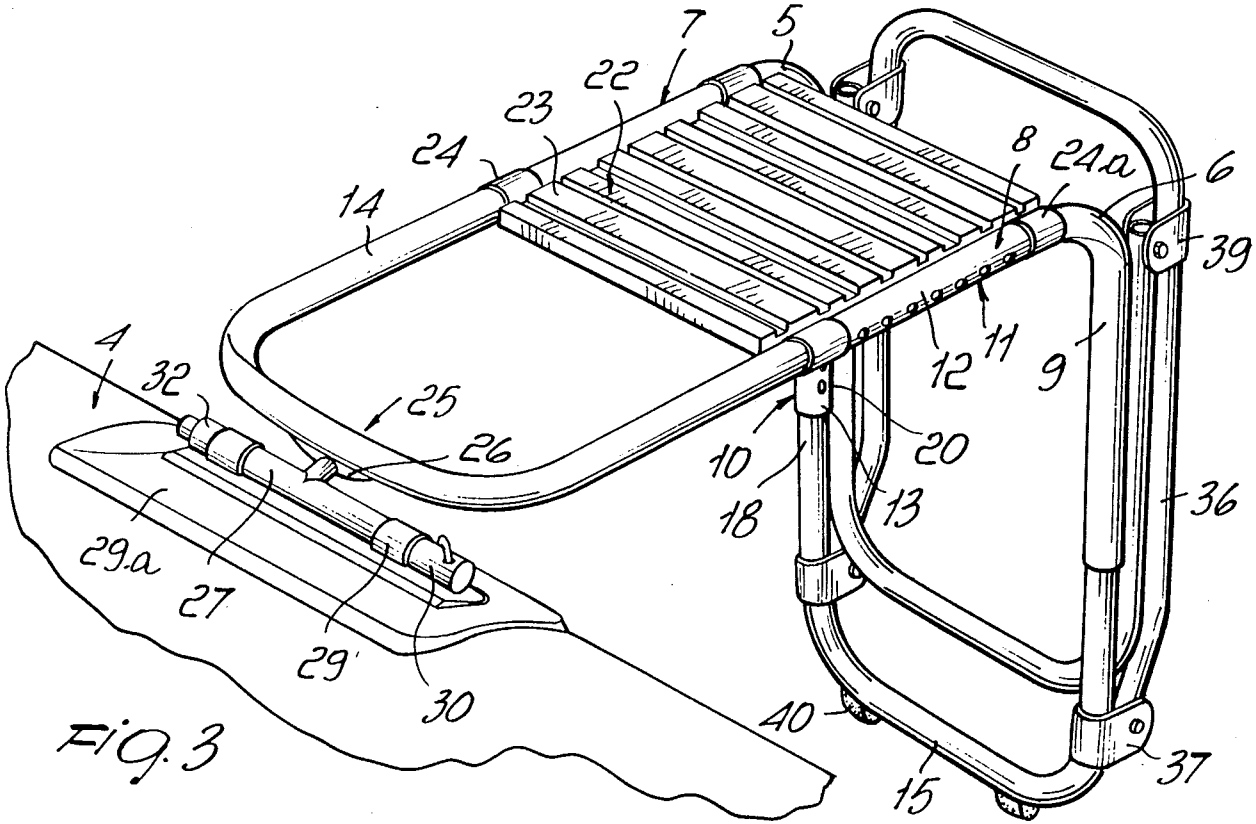
FIG. 3 is a perspective view of this boat ladder similar to FIG. 2. but shown arranged inboard of an inflatable boat buoyancy tube. the view illustrating the latch system.
Figure 4:
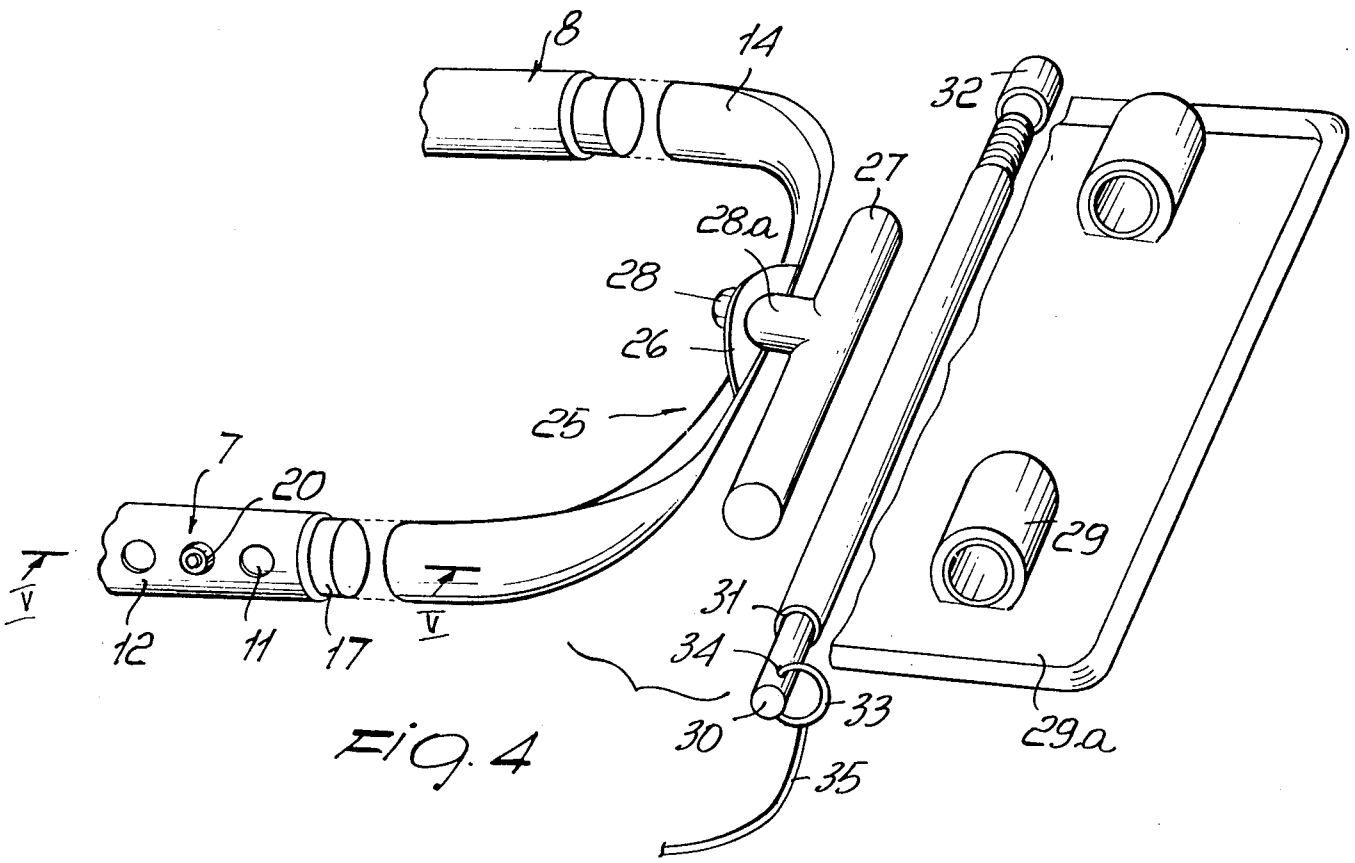
FIG. 4 is a perspective view of the U-like element intended for engagement with a bracket attached to the boat.
Figure 5:
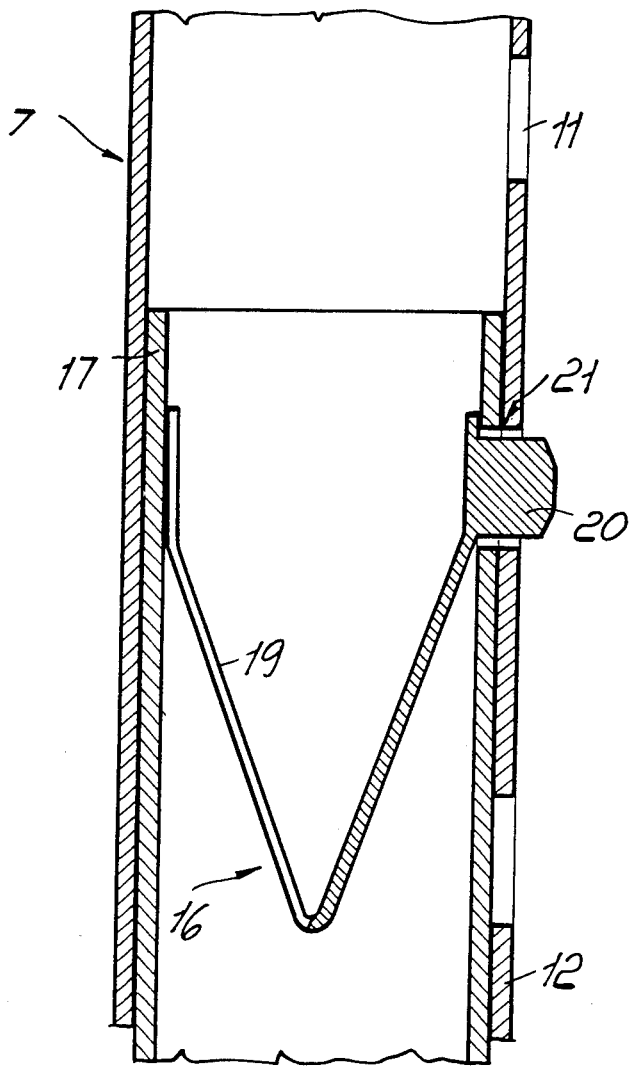
FIG. 5 is a sectional view taken on the plane V—V of FIG. 4.

FIG. 2 illustrates the use of the ladder as positioned against the topsides of a boat with the rungs folded up, while FIG. 3 shows a different arrangement of the same, inboard of the bottom topsides.

In fact, by providing two rubber pads 40 at the bottom of the U-like element 15, the structure 3 may be utilized as a seat or rest surface inside the boat.

This is specially advantageous if it is considered that the available room is limited, since the ladder can be used in a desired way thanks to the pivotal movements afforded by the wire 30 and bolt associated with the wire 28 inserted through the short pipe section 28*a*, in turn welded to the pipe section 27.

A further advantage results from the plate 29*a* being attachable to the gunwale region or top of an inflatable boat or other boat to then enable the ladder proper to be secured therto, the ladder, when not in use, being detachable by provision of the removable latch means provided.

Finally, it is also easy to carry the ladder, since both the rungs 26 and L-like elements 5 and 6 can be folded by removing the U-like element 14, the flat rest base member 22 being also folded by pivoting it about one of the sidepieces 7 and 8.

Thus, it may be seen that the invention reaches all of the objects set forth, and it should be pointed out that in practice any materials or dimensions may be selected and used contingent on individual requirements.

I claim:

1. A universal folding ladder for boats, characterized in that it comprises a tubular structure intended for straddling the gunwale of a boat and including at least two L-like elements extending parallel to each other and being interconnected at the ends thereof by at least two adjustable U-like elements, said structure being connected, on the one side, to the boat through a latch means for a catch element, and on the other side, to swingingly connected rungs, between said L-like elements there being mounted a flat rest base member.

2. A universal folding ladder for boats, according to claim 1, characterized in that said tubular structure comprises metal L-like elements extending parallel to one another and having on the sidepieces thereof an array of holes aligned on a generatrix line of the cylinder defining the sidepiece and formed in the outward side surface of the sidepiece located over the boat gunwale and in the inward side surface of the sidepiece located alongside the gunwale.

3. A universal folding ladder for boats, according to claim 1 or 2, characterized in that said L-like elements are connected to tubular U-like metal elements of a slightly smaller diameter than the former and being adjustable relatively thereto through an adjustment device including an elastic V-like bar, inserted through the U-like element whereto there is welded to one end a small metal cylinder standing out of a hole formed at the end of said U-like element.

4. A universal folding ladder for boats, according to claim 1 or 2, characterized in that on the bottom of the U-like element located over the boat gunwale there is provided a latch means including a metal perforated bracket welded at the bottom, through said hole there being passed a bolt, subsequently associated with a nut, rigid with a first short pipe section in turn welded to a second pipe section lying parallel to the bottom of the U-like element, said pipe section being located between two substantially cylinderical catch elements of the same inside diameter and formed from a plastic material, rigid with a flat base member in turn attached to the boat gunwale, a wire being insertable through the catch elements and second pipe section.

5. A universal folding ladder for boats, according to claim 4, characterized in that said wire is formed at one end with a diametrical hole wherethrough a ring is inserted, and with a projecting step, at the other there being provided a thread for a locking ring nut.

6. A universal folding ladder for boats, according to claim 1 or 2, characterized in that said U-like element located alongside the boat gunwale has mutually swingingly connected rungs associated therewith, said connections being provided by C-like metal hinges attached one to each arm of a rung and having, those belonging to one and the same rung, a common pivot axis, the pivot pin comprising a bolt passed in between the holes formed at the free ends of the rungs and hinge and then secured by means of nut.

7. A universal folding ladder for boats, according to claim 1 or 2, characterized in that between the L-like elements, there is located a flat rest base member comprising one or more boards made rigid with one another and, in a detachable fashion, with the sidepieces of the L-like elements through semicylindrical metal supports, on the one side, and cylindrical supports on the other, having a larger diameter than that of said sidepieces.

8. A universal folding ladder for boats, according to claim 6, characterized in that said tubular structure, rungs, hinges, and latch means are formed from either stainless steel or aluminum, the boards of the rest base member being instead of either wood or a plastic material.

* * * * *